US006220578B1

(12) United States Patent
Popov

(10) Patent No.: US 6,220,578 B1
(45) Date of Patent: Apr. 24, 2001

(54) LIQUID-GAS JET APPARATUS WITH MULTIPLE NOZZLES AND VARIANTS

(76) Inventor: Serguei A. Popov, 4615 Post Oak Pl., Suite 140, Houston, TX (US) 77027

( * ) Notice: Subject to any disclaimer, the term of this patent is extended or adjusted under 35 U.S.C. 154(b) by 0 days.

(21) Appl. No.: 09/331,844

(22) PCT Filed: Oct. 22, 1998

(86) PCT No.: PCT/IB98/01690

§ 371 Date: Jun. 28, 1999

§ 102(e) Date: Jun. 28, 1999

(87) PCT Pub. No.: WO99/22147

PCT Pub. Date: May 6, 1999

(30) Foreign Application Priority Data

Oct. 29, 1997 (RU) ..... 97117774

(51) Int. Cl.[7] ..... B01F 3/04
(52) U.S. Cl. ..... 261/76
(58) Field of Search ..... 261/76

(56) References Cited

U.S. PATENT DOCUMENTS

| | | | | |
|---|---|---|---|---|
| 1,071,875 | * | 9/1913 | Buschei | 261/76 |
| 1,116,635 | * | 11/1914 | Singer et al. | 261/776 |
| 1,629,210 | * | 5/1927 | Feroldi | 261/76 |
| 5,628,623 | | 5/1997 | Skaggs . | |

FOREIGN PATENT DOCUMENTS

| | | | | |
|---|---|---|---|---|
| 50124 | * | 10/1911 | (AT) | 261/76 |
| 51229 | | 4/1890 | (DE) . | |
| 509491 | * | 7/1939 | (GB) | 261/76 |
| 985462 | | 12/1982 | (SU) . | |
| 1054580 | | 11/1983 | (SU) . | |
| 1483106 | | 5/1989 | (SU) . | |
| 1755714 | | 8/1992 | (SU) . | |

OTHER PUBLICATIONS

Sokolov E.Y., "Jet Apparatuses" book, 1970, USSR, Moscow, "Energy" Publishing house, p. 229.

* cited by examiner

*Primary Examiner*—C. Scott Bushey
(74) *Attorney, Agent, or Firm*—Mark A. Oathout

(57) ABSTRACT

The invention pertains to the field of jet technology and essentially relates to a multi-nozzle jet apparatus. Each nozzle of the apparatus is furnished with a filter element installed at the inlet side of the nozzle. The filter element constitutes a sleeve with longitudinal apertures in its side wall, the total surface area of the apertures in each filter element exceeds more than twice the surface area of the cross-section of the throat of the nozzle, the width of each aperture in the filter element is at least two times smaller than the shortest distance between the opposite walls in the cross-section of the nozzle in the zone of the throat of the nozzle. Each mixing chamber is furnished with an inlet duct located in the receiving chamber, the height of each inlet duct represents from 0.05 to 86 times its diameter. This invention provides improved effectiveness and reliability of the multi-nozzle liquid-gas jet apparatus.

3 Claims, 1 Drawing Sheet

LIQUID-GAS JET APPARATUS WITH MULTIPLE NOZZLES AND VARIANTS

CROSS REFERENCE TO RELATED APPLICATIONS

This application is a 371 of PCT/IB98/01690, filed Oct. 22, 1998 with priority of RU 97117774, filed Oct. 29, 1997.

BACKGROUND OF THE INVENTION

The invention pertains to the field of jet technology, primarily to jet apparatuses intended for producing a vacuum in various units, for example in vacuum rectifying columns.

There is a liquid-gas jet apparatus known, which comprises a nozzle for feed of a motive vapor medium, a mixing chamber and a diffuser (see, DE patent 51229, class 59 c, 13,1890).

This jet apparatus has a low efficiency factor. Additionally, high energy inputs are required to produce the motive vapor medium.

The closest analogue to the jet apparatuses described in the present invention is a multi-nozzle liquid-gas jet apparatus, which has a chamber for feed of a liquid medium with a grillage placed at the chamber's outlet, active nozzles installed in the slots of the grillage, a receiving chamber, a branch pipe for feed of an evacuated gaseous medium, mixing chambers placed in alignment to each nozzle, and a discharge chamber (see book by Sokolov E. Y. and others "Jet apparatuses", M., Energy, 1970, page 229).

This jet apparatus allows evacuation of large amounts of vapor-gas mediums. However such apparatuses have a rather low efficiency factor because of high energy losses during passing of an evacuated medium to the jets of an active (ejecting) liquid medium. Besides, the absence of means preventing ingress of foreign objects, which affect apparatus performance, into the nozzles of the jet apparatus reduces reliability of this apparatus.

SUMMARY OF THE INVENTION

The present invention is aimed at an increase in efficiency of the multinozzle jet apparatus by reducing energy losses during feeding of evacuated and active mediums, and at an increase in reliability of the jet apparatus by preventing penetration of objects, which could disturb operation of the apparatus, into the nozzles and by preventing reverse flow from the outlet of the jet apparatus into its receiving chamber.

The mentioned problem is solved as follows. A multi-nozzle liquid-gas jet apparatus, which comprises a chamber for feed of a liquid medium, a grillage placed at the outlet of the chamber, active nozzles installed in the slots of the grillage, a branch pipe for feed of an evacuated gaseous medium, mixing chambers placed in alignment to each nozzle, and a discharge chamber, is modified so that each nozzle is furnished with a filter element installed at its inlet side. The filter element constitutes a sleeve with longitudinal apertures in its side wall. The total surface area of the apertures of the filter element exceeds more than twice the surface area of the cross-section of the nozzle's throat, and the width of each aperture in the filter element is at least two times smaller than the shortest distance between the opposite walls in the cross-section of the nozzle's throat.

There is another variant for implementation of the multi-nozzle liquid-gas jet apparatus comprising a chamber for feed of a liquid medium, a grillage placed at the outlet of the chamber, active nozzles installed in the slots of the grillage, a branch pipe for feed of an evacuated gaseous medium, mixing chambers placed in alignment to each nozzle, and a discharge chamber. In this variant each mixing chamber is furnished with an inlet duct located in the receiving chamber, the height of each inlet duct represents from 0.05 to 86 times its diameter.

The executed research showed, that in operation of units which include the multi-nozzle liquid-gas jet apparatus the operation is often unreliable. The conditions decreasing reliability are initiated, when a part of a mixture of active and evacuated mediums flows from the outlet of the apparatus back into the receiving chamber of the apparatus. Sometimes foreign objects, for example caix, get into the nozzles of the jet apparatus as well. And because the nozzle of the jet apparatus is the narrowest flow-through canal of the whole unit the throat of the nozzle is blocked up first. All of these factors adversely affect performance of the jet apparatus. On the other hand, conventional filter elements installed at the liquid inlet of the apparatus create big hydraulic resistance and reduce efficiency of the jet apparatus. Besides, the mechanism for feeding of the liquid medium into the nozzles exerts great influence on the operation of the entire jet apparatus, because an equal pressure at the inlets of all nozzles of the multi-nozzle jet apparatus is required for optimal performance of the jet apparatus.

It was discovered, that it is advisable to furnish each nozzle with its own filter element. Such a design of the jet apparatus allows the filters to be made hydraulically "transparent". This means, that these filters practically do not create a pressure differential when a liquid active medium passes through them. Such became possible due to the special design of the filter element. Each filter element represents a sleeve with longitudinal apertures in its side wall. The total surface area of the apertures in each of the filter elements exceeds more than twice the surface area of the cross-section of the nozzle's throat, and the width of each aperture of the filter element is at least two times smaller than the shortest distance between the opposite walls in the cross-section of the throat.

The location of the apertures on the sleeve is also important. It was discovered, that the availability of the longitudinal apertures helps to equalise pressure at the inlets of liquid active nozzles and consequently provides an almost equal flow rate of a liquid active medium through each nozzle. One resulting effect, is that the jet apparatus operates more effectively.

Along with the above mentioned important features of the invention, the organization of the access for the evacuated medium to the jets of the liquid active medium has significant influence on operation of the jet apparatus.

When the inlet ducts of the mixing chambers are located in the receiving chamber a distributive space is created in the receiving chamber, so that an easier and more uniform access for the evacuated medium to all jets (peripheral and central) of the active liquid medium is provided. As a result effectiveness of the jet apparatus rises due to an increase in its capacity. This taken in conjunction with a more balanced distribution of the active medium to the nozzle inlets prevents reverse flow of the mixture of mediums into the receiving chamber. Consequently operation of the jet apparatus becomes more reliable because of a nearly uniform pressure field of the active medium at the inlets of all nozzles of the jet apparatus and equal admittance of the evacuated medium to all jets for the active medium provides operation of all mixing chambers in the same mode. Thus an occurrence of a pressure difference between the mixing chambers is prevented. Therefore conditions do not exist for an outbreak of a part of the mixture of the active and evacuated mediums' mixture from the discharge chamber into the receiving chamber. Optimal proportions between the height and the diameter of each inlet duct to the mixing chamber was discovered. It was determined, that when the height of the inlet duct represents from 0.05 to 86 times its diameter, the evacuated medium is received with minimum hydraulic losses. When the proportion is more than 86 performance of the jet apparatus is not improved and further increase of the proportion is useless.

So, as it is clear from the aforesaid, the described solutions provide an increase in reliability and effectiveness of the multi-nozzle liquid-gas jet apparatus.

BRIEF DESCRIPTION OF THE DRAWINGS

The drawing in FIG. 1 schematically represents a longitudinal section of the described multi-nozzle liquid-gas jet apparatus.

DETAILED DESCRIPTION

Figure 1:
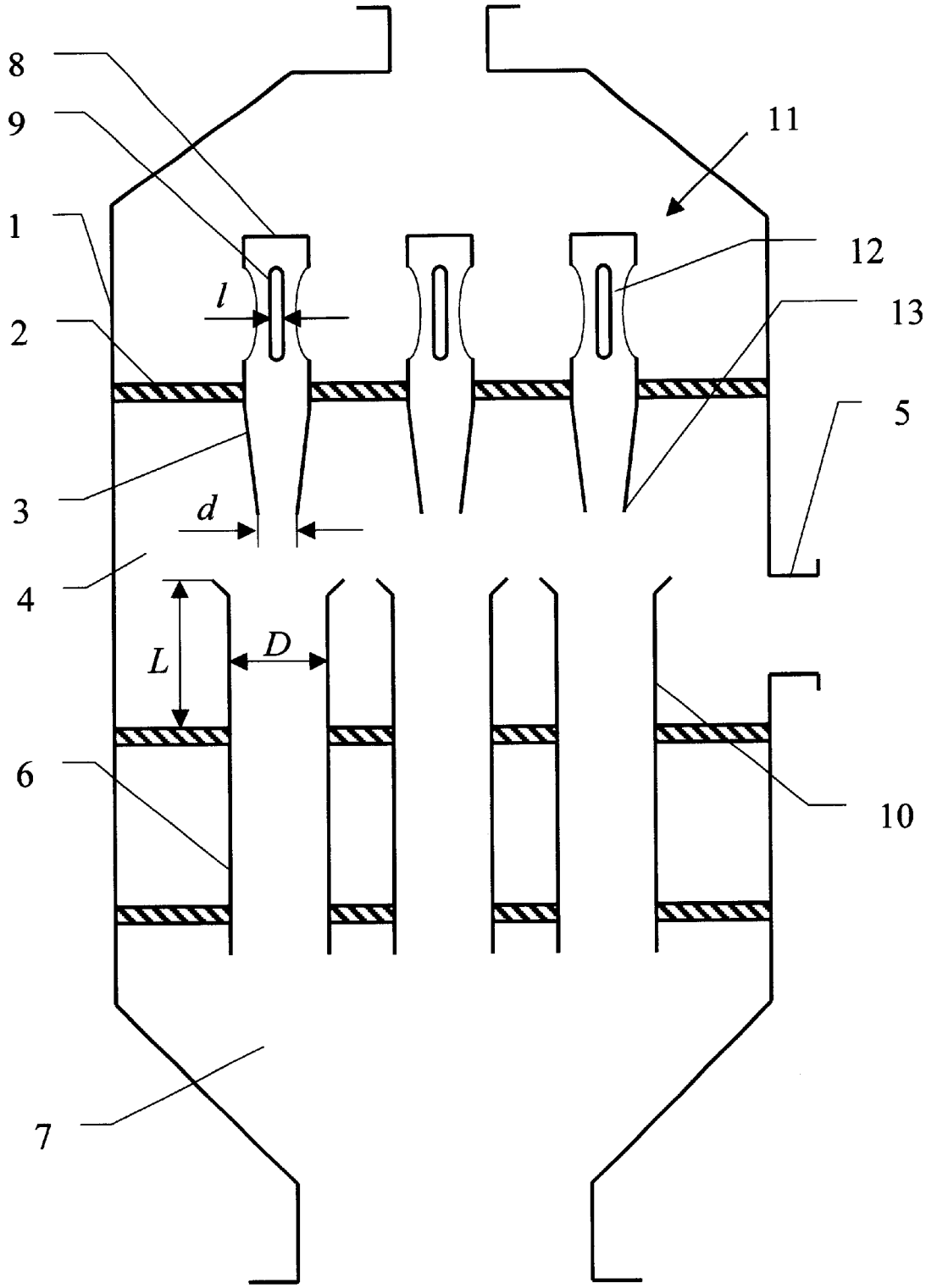

The multi-nozzle liquid-gas jet apparatus comprises a chamber 1 for feed of a liquid medium, a grillage 2 having slots where the grillage 2 is placed at the outlet of the chamber 1, liquid active nozzles 3 installed in the slots of the grillage 2, a receiving chamber 4, a manifold 5 for feed of an evacuated gaseous medium, mixing chambers 6 placed in alignment with each nozzle 3, and a discharge chamber 7. Each nozzle 3 is furnished with a filter element 8 installed at the inlet side of the nozzle 3 and constituting a sleeve 11 having longitudinal apertures 9 in the side wall 12 of the filter element 8. The total surface area of the apertures 9 in each filter element 8 exceeds more than twice the surface area of the cross-sectional area of the throat of the nozzle 3, the width (P) of each aperture 9 in the filter element 8 is at least two times smaller than the shortest distance (d) between the opposite walls 13 in the cross-section of the nozzle 3 in the zone of the throat of nozzle 3.

Each mixing chamber 6 is furnished with an inlet duct 10 located in the receiving chamber 4. The height (L) of each inlet duct 10 represents from 0.05 to 86 times the diameter (D) of the inlet duct 10.

The multi-nozzle liquid-gas jet apparatus operates as follows.

An active liquid medium goes into the chamber 1, where it is distributed between the nozzles 3. From the chamber 1 the liquid medium goes into the liquid active nozzles 3 through the filter elements 8. The active medium effusing from the nozzles 3 entrains an evacuated gaseous (vapour-gaseous) medium from the receiving chamber 4 into the mixing chambers 6. In the mixing chambers 6 the liquid active and evacuated gaseous mediums are mixed. A part of the easy-condensable components of the gaseous medium is often condensed in the liquid active medium during mixing of the mediums. A gasliquid mixture from the mixing chambers 6 flows into the discharge chamber 7. During evacuation, the gaseous medium gets into the receiving chamber 4 of the jet apparatus through the manifold 5. In the receiving chamber 4 the gaseous medium is uniformly distributed between the mixing chambers 6 in the space in front of the inlet ducts 10. If foreign objects, which can block the active nozzles 3, get into the jet apparatus together with the liquid active medium, such foreign objects are entrapped by the filter elements 8, are washed off by the flow of the active medium and settle on the grillage 2. Later on the foreign objects are removed from the jet apparatus during scheduled maintenance.

INDUSTRIAL APPLICABILITY

Present invention can be applied in chemical, petrochemical and some other industries.

What is claimed is:

1. A multi-nozzle liquid-gas jet apparatus having a chamber for feed of a liquid medium, a grillage having slots with the grillage placed at the outlet of the chamber, a plurality of liquid active nozzles installed in the slots of the grillage, a receiving chamber adjacent to the nozzles, a manifold connected to the receiving chamber for feed of an evacuated gaseous medium, a plurality of mixing chambers, one each, placed in alignment with each of the nozzles, and a discharge chamber adjacent to the mixing chambers:

wherein each nozzle includes a filter element installed at an inlet end and a wall defining a throat at the other end of the nozzles, wherein the filter element comprises a sleeve having a side wall defining a plurality of longitudinal apertures, wherein the total surface area of the longitudinal apertures in each filter element is greater than twice the surface area of the cross-section of the throat of each nozzle, and wherein the width of each longitudinal aperture in the filter elements is at least two times smaller than the shortest distance between the wall sections opposing each other in the cross-section of the throat of each nozzle.

2. The multi-nozzle liquid-gas jet apparatus according to claim 1 wherein each mixing chamber has an inlet duct located in the receiving chamber, and each inlet duct has a height in the range of from 0.05 to 86 times a diameter of the inlet duct.

3. A multi-nozzle liquid-gas jet apparatus having a chamber for feed of a liquid medium, a grillage having slots with the grillage placed at the outlet of the chamber, a plurality of liquid active nozzles installed in the slots of the grillage, a receiving chamber adjacent to the nozzles, a manifold connected to the receiving chamber for feed of an evacuated gaseous medium, a plurality of mixing chambers, one each, placed in alignment with each of the nozzles, and a discharge chamber adjacent to the mixing chambers:

wherein each mixing chamber has an inlet duct located in the receiving chamber, and each inlet duct has a height in the range of from 0.05 to 86 times a diameter of the inlet duct.

* * * * *